United States Patent [19]

Benson

[11] 4,185,276

[45] Jan. 22, 1980

[54] SOUND AND LIGHT DISPLAY

[76] Inventor: Robert G. Benson, 720 N. Wabash Ave. #601, Chicago, Ill. 60611

[21] Appl. No.: 837,834

[22] Filed: Sep. 29, 1977

[51] Int. Cl.[2] ..... G08B 5/36

[52] U.S. Cl. ..... 340/366 B; 340/148

[58] Field of Search ..... 340/366 B, 148; 84/464

[56] References Cited

U.S. PATENT DOCUMENTS

| | | | |
|---|---|---|---|
| 1,690,279 | 11/1928 | Craft | 84/464 |
| 3,018,683 | 1/1962 | Way | 84/464 |
| 3,240,099 | 3/1966 | Irons | 84/464 |
| 3,241,419 | 3/1966 | Gracey | 84/464 |
| 3,540,343 | 11/1970 | Rifkin | 84/464 |
| 3,869,699 | 3/1975 | Haller | 340/148 |
| 3,919,915 | 11/1975 | Isbell | 84/464 |

*Primary Examiner*—Harold I. Pitts

*Attorney, Agent, or Firm*—Wegner, Stellman, McCord, Wiles & Wood

[57] ABSTRACT

A spatial energy field including a sound and light generator and discriminator for providing electrical signals to a plurality of individual stations. Each station includes a set of speakers arranged in a vertical column and a plurality of lights of selected colors positioned in relationship with the speakers. The lights form a color progression in accordance with the natural spectrum of light. The light and sound from the stations are spatially and temporally coordinated so that organically unified musical pitches and lights can form dynamic geometrical shapes, patterns and designs.

5 Claims, 5 Drawing Figures

SOUND AND LIGHT DISPLAY

BACKGROUND OF THE INVENTION

This invention relates to a sound and light display and, more particularly, to a display wherein the light is temporally and spatially coordinated with the sound.

There exists a variety of light displays which are responsive to energy within the audible range. Also, there are light displays capable of forming various patterns, such as geometrical shapes, in response to audible energy. Although these displays provide enjoyment to the viewer and listener, there is no temporal or spatial coordination between the frequency or pitch of the sound emitted and the color of the light which is energized in response thereto.

SUMMARY OF THE INVENTION

I have discovered that a synergistic effect is realized by coordinating the sound emanated from the display with the lights of the display to form what I refer to as a spatial energy field. Specifically, the lights are arranged with a column of sound speakers, and the color of the individual lights progresses vertically in accordance with the natural spectrum of light. The lights are responsive to the frequency or pitch of the sound from the speaker.

Depending upon the sound and light signals applied to the spatial energy field, various dynamic geometrical shapes, patterns and designs can be made, and the lights which are energized will be spatially and temporally related to the sound emanating from the speakers. Depending upon the position of the lights with respect to the speakers, two arrangements are realized. In one arrangement, the lower the frequency of the sound emitted, the darker the color of the light energized. In the other arrangement, the lower the frequency of the sound emitted, the lighter the color of the light energized.

It is a feature of the present invention to provide a station of vertically positioned lights wherein the light progresses in accordance with the naturally occurring spectrum of light and the speakers are arranged with respect to the lights for temporal and spatial coordination.

It is another feature of the present invention to provide a spatial energy field which includes a plurality of stations enclosing an area so that the sound and light are capable of forming unified musical pitches and lights into dynamic geometrical shapes, patterns and designs.

DESCRIPTION OF THE PREFERRED EMBODIMENT

For the purpose of this invention, a spatial energy field means an arrangement of lights of various colors and speakers wherein the energization of a light of a particular color and its position is coordinated with the position from which the sound emanates.

Figure 1:
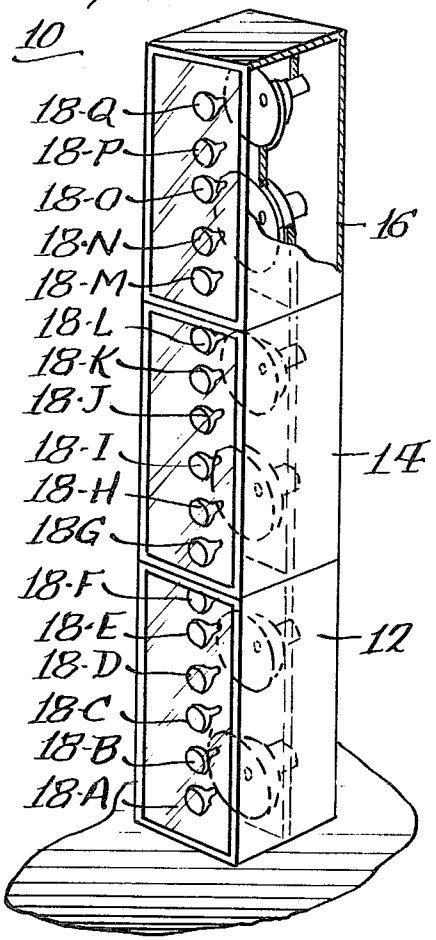
FIG. 1 is a perspective view of a typical station having vertically positioned lights and speakers in accordance with the present invention.

Referring to FIG. 1, a single station 10 is shown to include bass speaker 12, a mid-range speaker 14 and a treble speaker 16. Each speaker is vertically positioned with respect to the other two. Although the speakers are shown to be adjacent each other, they may be equally spaced by any selected distance so long as they remain in vertical relationship.

Station 10 also includes a plurality of equally spaced lights 18A–18Q. As will be described below, the energization of each light is individually controlled and the plurality of lights is arranged in vertical relationship, preferably in front of the speakers 12, 14 and 16. The lights are of individual colors and form a color progression in accordance with the natural spectrum of light. The individual lights may be energized by switches or may be responsive to a particular frequency of sound which emanates from speakers 12, 14 and 16. In order to obtain the unity of the light with the sound, it is preferable that light 18 having the darkest color be located in front of the bass speaker 12 and the light having the lightest color be located in front of treble speaker 16. The lights therebetween are selected in accordance with the color progression of the naturally occurring spectrum of light. Although the upward progression of color (light 18A having the darkest color to the light 18Q having the lightest color) will be described, the color progression could be reversed, but the placement of the bass speaker 12 and the treble speaker 18 might also be reversed.

Figure 2:
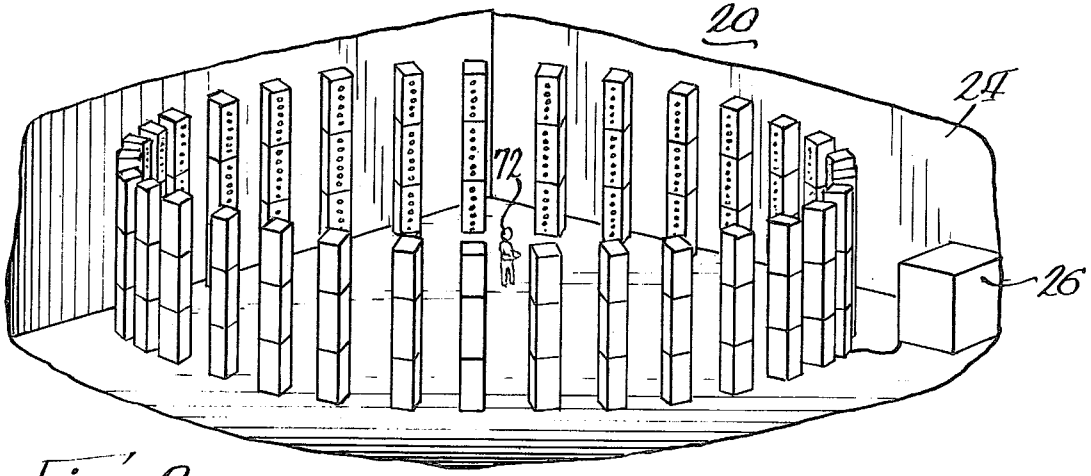
FIG. 2 is a perspective view of the spatial energy field having thirty-two stations of the type shown in FIG. 1.

Referring to FIG. 2, a spatial energy field 20 is shown and includes a plurality of spaced-apart stations 10 arranged in a continuous endless array. The stations are spaced apart by a sufficient distance to permit an observer 22 to pass through adjacent stations. The spatial energy field may vary in size from twenty feet in diameter to several hundred feet, and in height from ten feet to a much greater height. Generally, the size of the field is limited by the size of building 24. Although the spatial energy field 20 is shown to be circular, it could be arranged to form a dome, a cone, a pyramid, a cube, a rectangular solid, or a polygon, such as an octagon. Each station of the spatial energy field and each light within the station receives information from a control unit 26. Control unit 26, which may be a computer or an amplifier having a multi-channel sensing circuit for sensing a multi-channel sound track, may be programmed to provide organically unified musical pitches and lights into geometrical shapes, patterns and designs. Since the lights and the speakers are arranged in the manner discussed above, the particular light which is energized and the sound emanated will be temporally and spatially coordinated in the spatial energy field.

As an example of the placement of the lights of various colors and the approximate frequencies or pitches to which they respond, each of the thirty-two stations shown in FIG. 2 may be similarly constructed as follows:

| Name of Note | Frequency Of Note (Hz) | Light Level | Color |
|---|---|---|---|
| C | 4096 | 18Q | White |
| G | 3136 | 18P | Pale yellow |
| C | 2048 | 180 | Golden yellow |
| G | 1568 | 18N | Less greenish yellow |
| C | 1024 | 18M | Greenish yellow |
| G | 784 | 18L | Yellowish green |
| C | 512 | 18K | Green |
| G | 392 | 18J | Bluish green |
| C | 256 | 18I | Greenish blue |
| G | 196 | 18H | Turquoise |
| C | 128 | 18G | Blue |
| G | 98 | 18F | Purple blue |
| C | 64 | 18E | Purple |
| G | 49 | 18D | Red purple |
| C | 32 | 18C | Crimson |
| G | 24.5 | 18B | Red |
| C | 16 | 18A | Deep dark red |

Thus, for the spatial energy field of FIG. 2, there are seventeen lights per station 10 and thirty-two stations, for a total of five hundred forty-four lights. It is apparent that many more lights could be used so long as the colors are selected in a manner consistent with the progression of the natural spectrum of light. It is appreciated that a greater number of lights and a greater number of speakers would increase the effectiveness of the spatial energy field 20.

The observer 22 located within energy field 20 will, depending upon the information from control unit 26, be able to see and hear a sound and light display which is capable of moving vertically (as a function of pitch or frequency of the sound) and horizontally (as a function of the time of occurrence). Geometrical shapes of light and sound can be formed by the evenly spaced lights and sound sources.

Figure 5:
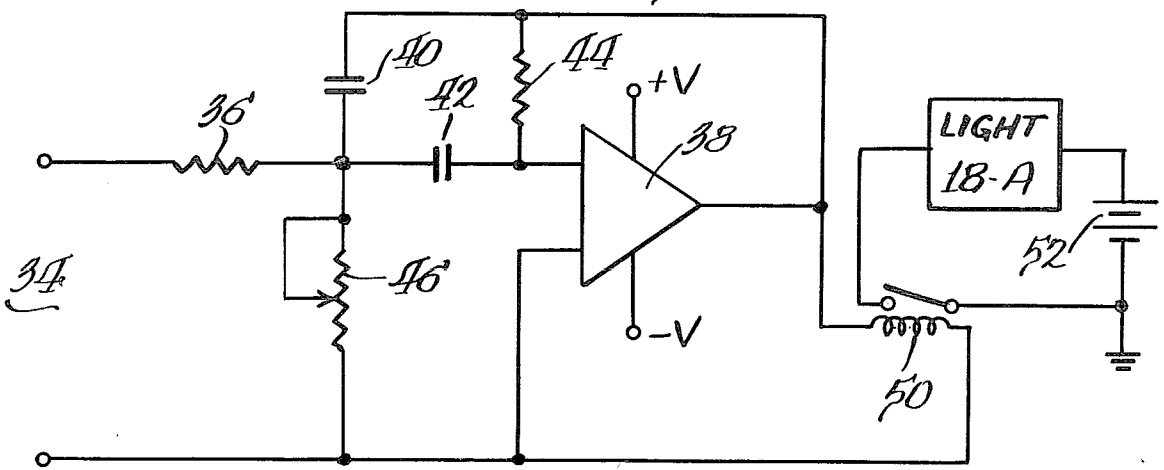
FIG. 5 is a schematic diagram of a typical frequency discriminator which can be employed at the individual stations to control the energization of the individual lights at that station.
Figure 3:
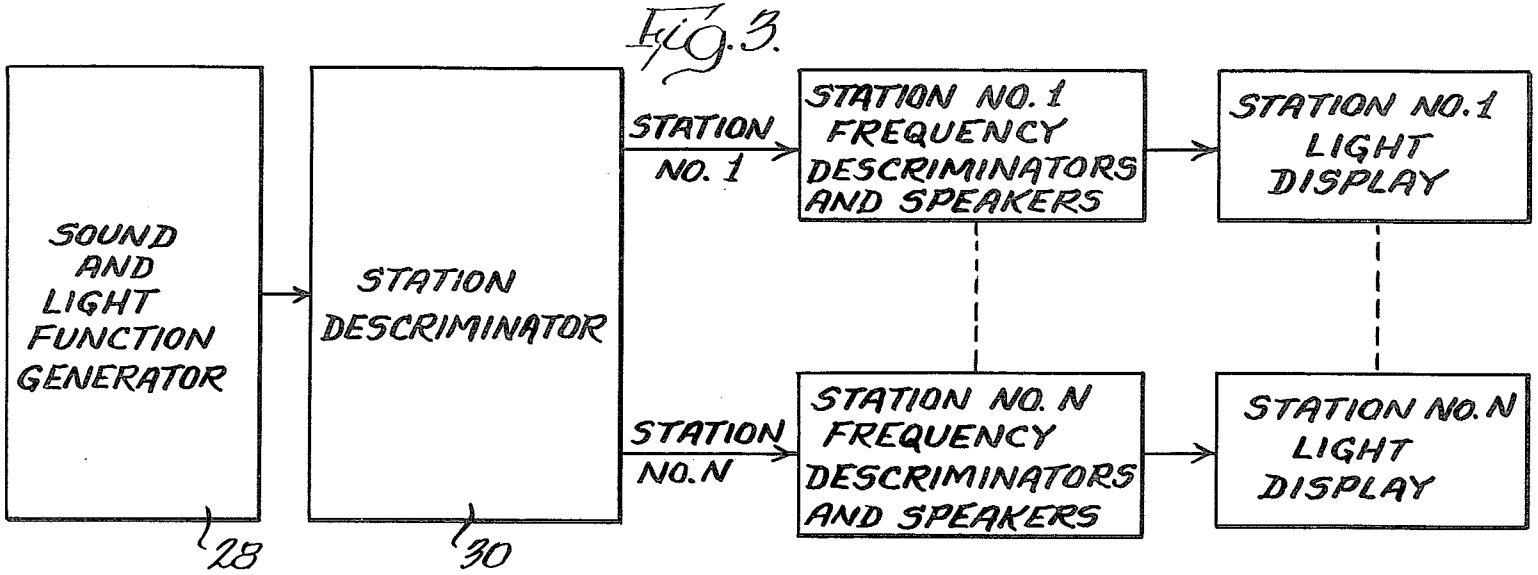
FIG. 3 is a block diagram of a circuit for driving the spatial energy field of FIG. 2 having N stations.
Figure 4:
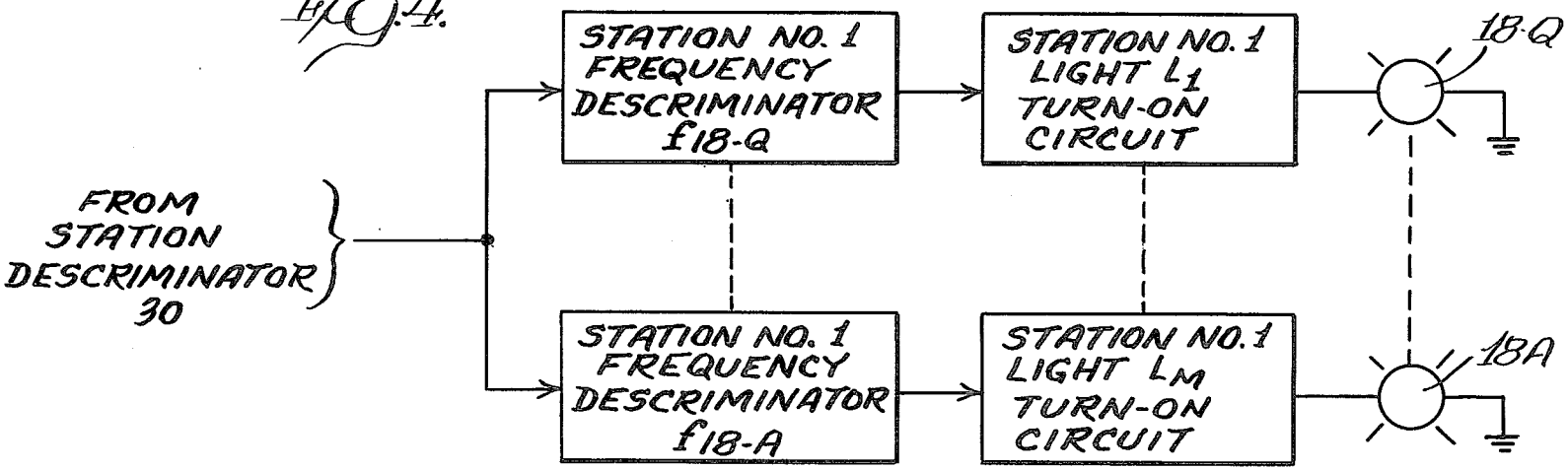
FIG. 4 is a block diagram of a circuit for controlling M individual lights for the station shown in FIG. 1.

Referring to FIGS. 3–5, the operation of control unit 26, which controls spatial energy field 20, will now be described. A sound and light function generator 28 is coupled to a station discriminator 30. The sound and light function generator 28 may be a computer programmed to provide electrical signals representative of sounds of a various frequency, or may be an amplifier from a musical instrument or a recording tape. Alternatively, the sound and light function generator 30 could provide two separate electrical signals, one representing the sound and the other for controlling the energization of the lights, as will be explained below.

The signals from sound and light function generator 28 are applied to station discriminator 30 which discriminates between the individual stations shown in FIG. 2 on the basis of time of occurrence or the relative position of the information from the sound and light function generator 28. Specifically, in one embodiment, sound and light function generator 28 would be a computer which provides electrical signals to successive stations, sound discriminator 30 would be a multiplexing unit having N individual outputs as shown in FIG. 3. Alternatively, in another embodiment, sound and light function generator 28 would be a recording tape, station discriminator 30 would be a plurality of tape sensing heads aligned transversely to the movement of a multi-channel tape so that each head receives a specific channel of information to N outputs therefrom. The N individual outputs from the station discriminator are individually connected to the speakers of each station in the energy field and to the individual frequency discriminators in each station. When a plurality of stations are arranged to provide a spatial energy field, horizontal movement of the light and sound is dependent upon the information on the tape. The frequency discriminators are responsive to the frequency of the sound applied to them and, depending upon the frequency, energize one or more of the lights 18.

Referring to FIG. 4, each station 10 is provided with a plurality of frequency discriminators each of which is responsive to individual frequencies, as in the above Table. If the electrical signal from the station discriminator 30 represents a single frequency, one of the N station frequency discriminators will respond to that frequency to energize the appropriate light 18. Each light is individually controlled by a light turn-on circuit as shown.

As an alternative to the frequency discriminator as discussed above, it is apparent that the individual lights of the individual stations can be directly coupled to the sound and light function generator, especially if the sound and light function generator 28 is a computer.

Referring to FIG. 5, a typical frequency discriminator will be described for energizing light 18A. The input 34 is coupled to station discriminator 30 and is provided with electrical signals representing the sound applied to speakers 12, 14 and 16. Current flows through resistor 36 to establish a voltage across the input of operational amplifier 38. Capacitors 40 and 42, resistor 44 and variable resistor 46 are selected and adjusted so that an output voltage from operational amplifier 38 is present when the frequency of the voltage across the input of operational amplifier 38 equals 16 Hz (see Table above). A voltage on the output of operational amplifier 38 causes current to flow through coil 48, thereby closing switch 50. When switch 50 is closed, current from power source 52 energizes deep dark red light 18A. Other discriminators, individually adjusted for individual frequencies, are provided for each of the remaining lights of each station.

It is claimed:

1. A spatial energy system comprising:

a plurality of individual spaced-apart stations arranged in an effectively continuous, endless array forming a geometric shape defining a central position whereby said array effectively surrounds an observer positioned at said central position within said array, a plurality of said stations being disposed to permit the observer to pass therebetween to move inwardly and outwardly through said array, each of said stations having a vertically spaced-apart series of individually energizable lights; and means including a generator for generating a series of electrical signals arranged in a plurality of channels of information and with there being variable signals in a channel of information to provide selective sequential energization of said lights in patterns extending fully about said central position.

2. A spatial energy system comprising:

a plurality of individual spaced-apart stations arranged in an effectively continuous, endless array forming a geometric shape defining a central position whereby said array effectively surrounds an observer positioned at said central position within said array, a plurality of said stations being disposed to permit the observer to pass therebetween to move inwardly and outwardly through said array, each of said stations having a vertically spaced-apart series of individually energizable lights and a vertically spaced-apart series of individually energizable speakers; and means including a generator for generating a series of electrical signals arranged in a plurality of channels of information and there being variable signals in a channel of information to provide selective sequential energization of said lights and speakers in patterns extending fully about said central position.

3. A spatial energy system comprising:

a sound and light generator for providing electrical signals representative of various channels of various sound;

means for discriminating between one channel of sound and the other channels; and a plurality of individual stations positioned relative to each other to define an effectively continuous, endless circular array defining a central position whereby said array effectively surrounds an observer positioned at said central position within the array and which are coupled to said discriminating means, at least a plurality of said stations being spaced apart a distance sufficient to permit an observer to pass between adjacent stations inwardly and outwardly through said array, each station being responsive to a channel of information and each statiion including a set of speakers arranged in a vertical column, a plurality of lights of selected colors arranged in a vertical column, the lights being of different colors and forming a color progression in accordance with the natural spectrum of light, means for discriminating between various frequencies of said sound, and means responsive to said discriminating means for individually energizing said lights in response to the occurrence of a particular frequency of said sound.

4. The spatial energy system of claims 1, 2 or 3 wherein said generator includes a computer.

5. The spatial energy system of claim 3 wherein said generator includes a recording tape.

* * * * *